US005345955A

United States Patent [19]

Clearman et al.

[11] Patent Number: 5,345,955

[45] Date of Patent: Sep. 13, 1994

[54] COMPOSITE FUEL ELEMENT FOR SMOKING ARTICLES

[75] Inventors: Jack F. Clearman, Blakely, Ga.; Robert L. Meiring, Winston-Salem, N.C.; Jerry W. Lawson, Clemmons, N.C.; Kenneth O. Baker, Clemmons, N.C.

[73] Assignee: R. J. Reynolds Tobacco Company, Winston-Salem, N.C.

[21] Appl. No.: 947,002

[22] Filed: Sep. 17, 1992

[51] Int. Cl.[5] ..... A24D 1/00

[52] U.S. Cl. ..... 131/359

[58] Field of Search ..... 131/359

[56] References Cited

U.S. PATENT DOCUMENTS

| | | | |
|---|---|---|---|
| 4,708,151 | 11/1987 | Shelar | 131/359 |
| 4,714,082 | 12/1987 | Banerjee et al. | 131/359 |
| 4,732,168 | 3/1988 | Resce et al. | 131/359 |
| 4,756,318 | 7/1988 | Clearman et al. | 131/359 |
| 4,782,644 | 11/1988 | Haarer et al. | 53/282 |
| 4,793,365 | 12/1988 | Sensabaugh, Jr. et al. | 131/194 |
| 4,802,568 | 2/1989 | Haarer et al. | 196/389 |
| 4,807,809 | 2/1989 | Pryor et al. | 131/84.1 |
| 4,827,950 | 5/1989 | Banerjee et al. | 131/335 |
| 4,870,748 | 10/1989 | Hensgen et al. | 131/94 |
| 4,881,556 | 11/1989 | Clearman et al. | 131/359 |
| 4,889,143 | 12/1989 | Pryor | 131/331 |
| 4,893,637 | 1/1990 | Hancock et al. | 131/280 |
| 4,893,639 | 1/1990 | White | 131/369 |
| 4,903,714 | 2/1990 | Barnes et al. | 131/335 |
| 4,917,128 | 4/1990 | Clearman et al. | 131/359 |
| 4,928,714 | 5/1990 | Shannon | 131/359 |
| 4,938,238 | 7/1990 | Barnes et al. | 131/365 |
| 4,989,619 | 2/1991 | Clearman et al. | 131/194 |
| 5,025,814 | 8/1991 | Raker | 131/297 |
| 5,027,837 | 7/1991 | Clearman et al. | 131/359 |
| 5,038,802 | 8/1991 | White et al. | 131/194 |
| 5,042,509 | 8/1991 | Banerjee et al. | 131/71 |
| 5,052,413 | 10/1991 | Baker et al. | 131/77 |
| 5,060,666 | 10/1991 | Clearman et al. | 131/194 |
| 5,060,667 | 10/1991 | Strubel | 131/273 X |
| 5,065,776 | 11/1991 | Lawson et al. | 131/365 |
| 5,067,499 | 11/1991 | Banerjee et al. | 131/194 |
| 5,076,292 | 12/1991 | Sensabaugh, Jr. et al. | 131/194 |
| 5,076,297 | 12/1991 | Farrier | 131/369 |
| 5,088,507 | 2/1992 | Baker et al. | 131/380 |
| 5,099,861 | 3/1992 | Clearman et al. | 131/194 |
| 5,101,839 | 4/1992 | Jakob et al. | 131/352 |
| 5,105,831 | 4/1992 | Banerjee et al. | 131/194 |
| 5,105,837 | 4/1992 | Barnes et al. | 131/365 |
| 5,105,838 | 4/1992 | White et al. | 131/365 |

FOREIGN PATENT DOCUMENTS

| | | |
|---|---|---|
| 339590 | 11/1989 | European Pat. Off. . |
| 432538 | 6/1991 | European Pat. Off. . |

OTHER PUBLICATIONS

Chemical and Biological Studies of New Cigarette Prototypes That Heat Instead of Burn Tobacco RJR (1988).

*Primary Examiner*—William H. Grieb

*Attorney, Agent, or Firm*—Grover M. Myers; David G. Conlin

[57] ABSTRACT

The present invention is directed to improvements in carbonaceous fuel elements wherein (a) the fuel elements are provided with a composite support member which assists in retaining the fuel element within the cigarette structure during smoking, and (b) the fuel elements burn at a lower average temperature than previously known carbonaceous fuel elements. In one preferred embodiment of the present invention, the fuel element comprises at least two different materials contiguous throughout the length thereof, and including one material which burns, and another material which preferably does not burn, or burns more slowly than the burnable material. The non-burning, or substantially non-burning material is advantageously a heat exchange material such as graphite. In preferred embodiments, the nonburning support or retaining member extends beyond the periphery of the burnable material such that it interacts with the insulating jacket which surrounds the fuel element, locking the same in place, particularly during smoking.

25 Claims, 4 Drawing Sheets

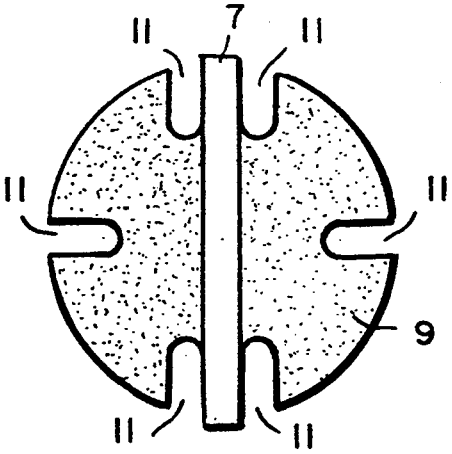
FIG. 2
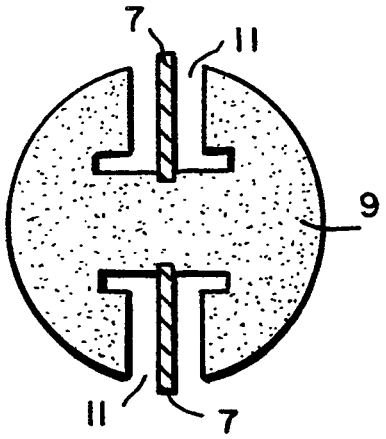
FIG. 3
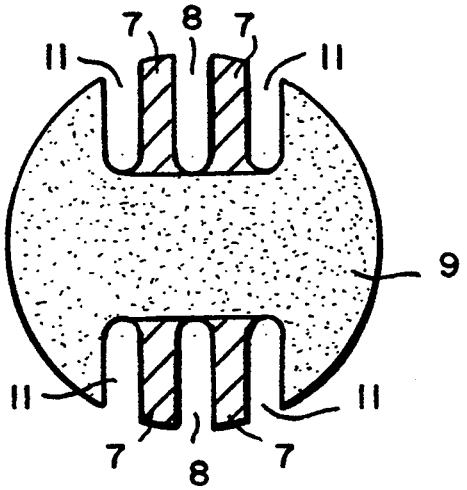
FIG. 4
FIG. 5
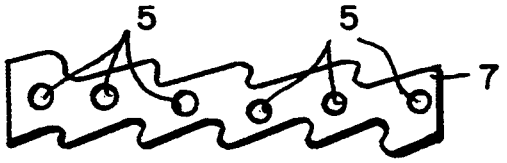
FIG. 6
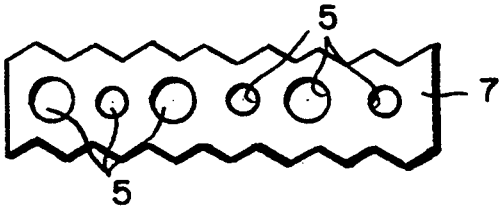
FIG. 7
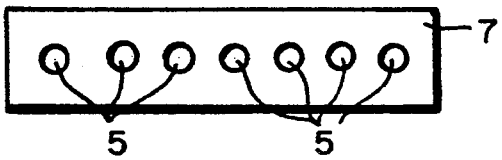

COMPOSITE FUEL ELEMENT FOR SMOKING ARTICLES

FIELD OF THE INVENTION

The present invention is directed to improvements in smoking articles, particularly smoking articles employing tobacco. Cigarettes, cigars and pipes are popular smoking articles which use tobacco in various forms. Many products have been proposed as improvements upon, or alternatives to, the various popular smoking articles. For example, numerous references have proposed articles which generate a flavored vapor and/or a visible aerosol. Most of such articles have employed a combustible fuel source to provide an aerosol and/or to heat an aerosol forming material. See, for example, the background art cited in U.S. Pat. No. 4,714,082 to Banerjee et al.

BACKGROUND OF THE INVENTION

The present invention relates to smoking articles such as cigarettes, and in particular to those smoking articles having a short fuel element and a physically separate aerosol generating means. Smoking articles of this type, as well as materials, methods and/or apparatus useful therein and/or for preparing them, are described in the following U.S. Pat. No. 4,708,151 to Shelar; U.S. Pat. No. 4,714,082 to Banerjee et al.; U.S. Pat. No. 4,732,168 to Resce; U.S. Pat. No. 4,756,318 to Clearman et al.; U.S. Pat. No. 4,782,644 to Haarer et al.; U.S. Pat. No. 4,793,365 to Sensabaugh et al.; U.S. Pat. No. 4,802,568 to Haarer et al.; U.S. Pat. No. 4,827,950 to Banerjee et al.; U.S. Pat. No. 4,870,748 to Hensgen et al.; U.S. Pat. No. 4,881,556 to Clearman et al.; U.S. Pat. No. 4,893,637 to Hancock et al.; U.S. Pat. No. 4,893,639 to White; U.S. Pat. No. 4,903,714 to Barnes et al.; U.S. Pat. No. 4,917128 to Clearman et al.; U.S. Pat. No. 4,928,714 to Shannon; U.S. Pat. No. 4,938,238 to Hancock et al., U.S. Pat. No. 4,989,619 to Clearman et al., U.S. Pat. No. 5,027,837 to Clearman et al., U.S. Pat. No. 5,038,802 to White et al., U.S. Pat. No. 5,042,509 to Banerjee et al., U.S. Pat. No. 5,052,413 to Baker et al., U.S. Pat. No. 5,060,666 to Clearman et al., U.S. Pat. No. 5,065,776 to Lawson et al., U.S. Pat. No. 5,067,499 to Banerjee et al., U.S. Pat. No. 5,076,292 to Sensabaugh et al., U.S. Pat. No. 5,076,297 to Farrier et al., U.S. Pat. No. 5,088,507 to Baker et al., U.S. Pat. No. 5,099,861 to Clearman et al., U.S. Pat. No. 5,101,839 to Jakob et al., U.S. Pat. No. 5,105,831 to Banerjee et al., and U.S. Pat. No. 5,105,837 to Barnes et al., as well as in the monograph entitled *Chemical and Biological Studies of New Cigarette Prototypes That Heat Instead of Burn Tobacco*, R J Reynolds Tobacco Company 1988 (hereinafter "RJR Monograph"). These smoking articles are capable of providing the smoker with the pleasures of smoking (e.g., smoking taste, feel, satisfaction, and the like). Such smoking articles typically provide low yields of visible sidestream smoke as well as low yields of FTC tar when smoked.

The smoking articles described in the aforesaid patents and/or publications generally employ a combustible fuel element for heat generation and an aerosol generating means, positioned physically separate from, and typically in a heat exchange relationship with the fuel element. Many of these aerosol generating means employ a substrate or carrier for one or more aerosol forming materials, e.g., polyhydric alcohols, such as glycerin. The aerosol forming materials are volatilized by the heat from the burning fuel element and upon cooling form an aerosol. Normally, the fuel elements of such smoking articles are circumscribed by an insulating jacket.

The fuel elements employed in the above-described smoking articles burn to produce combustion products such as carbon dioxide, carbon monoxide, water and trace quantities of other compounds. One known method for reducing the amount of carbon monoxide produced by the burning of a fuel element is to reduce the combustion temperature of that fuel element. Reducing the combustion temperature reduces the calories generated, thereby reducing the heat that must be dissipated during smoking. This assists in preventing overheating of the smoking article.

SUMMARY OF THE INVENTION

The present invention is directed to improvements in carbonaceous fuel elements wherein such fuel elements comprise a composite structure, a portion of which comprises a burnable or combustible carbonaceous material, and a portion of which comprises at least one support member which either does not burn, or which burns more slowly than the combustible portion (i.e., a non-burnable portion), thereby remaining intact during smoking and assisting in retaining the fuel element within the cigarette structure during smoking.

In preferred fuel elements of the present invention, the composite fuel element comprises at least two different materials, each of which is preferably contiguous to the other throughout the length of the fuel element. First, and primarily, a carbonaceous material which burns, and second, a material which does not burn, or burns very little or very slowly, particularly when compared to the burning material, and which provides a supporting structure as the remainder of the fuel element is otherwise consumed during smoking. The material in the fuel element of the present invention which does not burn completely during the life of the smoking article is hereafter referred to as "non-burning material."

The burnable carbonaceous material useful herein can be any carbonaceous composition capable of sustained burn during smolder. The patents described above disclose numerous combustible carbonaceous compositions which can be employed herein. As discussed therein, these compositions can contain optional fillers, extenders, additives (e.g., tobacco) and binders, if desired.

The non-burning material included in the fuel element preferably has good heat exchange and heat conductive properties, although other non-burning materials which do not exhibit such good heat exchange or conductive properties may also be used herein. Thus, preferred non-burning materials include extruded graphite or other non-burning carbon containing compositions, metal ribbons, foils, or the like. Exemplary non-burning materials with poor heat exchange and/or conductive properties include inorganic compounds such as calcium carbonate, ceramics and the like. Especially preferred non-burning materials include non-burning carbons such as extruded graphite, graphite foils, and metal ribbons, such as stainless steel, aluminum and copper. The currently most preferred non-burning materials are non-burning carbons such as graphite, which can easily be produced in an integral structure with the burnable carbonaceous material.

In most embodiments of the present invention, the burning and non-burning materials which comprise the fuel elements, form separate longitudinal components of the fuel element. Preferably the non-burning component forms a section which traverses the length of the fuel element, i.e., from end to end. Preferably the non-burning component(s) extend slightly beyond the periphery of the burnable carbonaceous material, thereby providing means for locking the fuel element in any jacket which surrounds it in a cigarette. Typically, the non-burning material is located centrally in the fuel element, dividing the burnable material equally into two parts. If desired, more than one section of non-burning material could be used in the fuel element, e.g., providing two or more sections of non-burning material. As the carbonaceous component of the fuel element burns, the non-burning portion does not, thereby maintaining its structure.

The fuel elements of the present invention provide two main benefits: retention of the burning fuel element within the cigarette throughout smoking, and reduced carbon monoxide production. In accordance with the present invention, the structure of the non-burning portion of the fuel element remains in contact with the insulating material during smoking. As a result, the burning carbonaceous component is retained within the insulating material throughout the burning period.

The reduction in carbon monoxide can be achieved in at least two ways. Preferably, the non-burning portion conducts some heat out of the burning portion of the fuel elements of the present invention, so that they tend to burn at a lower average temperature than previously known carbonaceous fuel elements. The reduced temperature of the burning fuel elements provides a reduction in carbon monoxide output. While the fuel elements of the present invention burn at a cooler temperature than previously known fuel elements, they do not go out during smolder, and they still provide sufficient heat energy to generate aerosol over the 10–15 puff life of the cigarettes in which they are employed.

Moreover, the lack of necessity of maintaining an unburned plug of burnable fuel in order to retain the fuel element in the cigarette means that fuel elements can now be designed such that only the amount of combustible material necessary to provide the desired number of puffs of aerosol needs to be included therein. Thus, the fuel composition can be formulated to provide only the amount of energy needed to drive the cigarette. No excess combustible material is needed to retain the fuel element within the smoking article. Thus the size and mass of the fuel element can be reduced, and the smaller the amount of carbonaceous material burned, the less carbon monoxide is generated.

The fuel element may be formed by coextruding a non-burning material and a burning material. The burnable carbonaceous component may be extruded onto the surface of the non-burning material, preferably on both sides thereof, or the non-burning material can be extruded on at least one side, preferably both sides, of the burnable carbonaceous material.

Alternatively, the non-burning component may be in the form of a strip or ribbon which is passed through an extruder and the carbonaceous material is extruded onto the non-burning material. If a ribbon is used, openings may be provided through the ribbon so that, as the burnable carbonaceous material is extruded, it can flow through the openings to form an integral link between the carbonaceous sections on opposite sides of the ribbon. If the ribbon is an exceptionally good conducting material, such as a graphite or metal foil, the openings help to reduce the heat exchange area between the carbonaceous material and the non-burning material so that the heat transfer to the non-burning material is inadequate to cause extinguishment of the burnable portion of the fuel element, particularly during smolder periods.

By using a non-burning component in contact with the insulating material, the fuel element is maintained in the cigarette structure without the unburned portion of fuel which previously was retained by the insulating material. This permits the reduction in size of the fuel element, so that only the appropriate amount of burnable carbonaceous material need be used to generate the desired amount of aerosol. Reduction in the amount of carbon burned also reduces the amount of heat generated by the fuel element, which also reduces the amount of carbon monoxide produced during burning.

The non-burning component of the fuel element may be incorporated into the combustible fuel element by any means available to the skilled artisan. One preferred incorporation route is the longitudinal coextrusion of a non-burning or substantially non-burning carbonaceous mass, e.g., carbon or graphite, with the burnable carbonaceous fuel composition. Longitudinal coextrusion allows the formation of intricate fuel element designs, each of which has desirable lighting and/or burning properties. In especially preferred embodiments, at least a portion of the coextruded non-burnable material extends beyond the periphery of the fuel element, thereby allowing the exposed material to lock into any insulating jacket or other overwrap employed around the periphery of the fuel element.

Another preferred route for the incorporation of a non-burning heat exchange material into the extruded fuel element is the so-called "ribbon-pull" method. In this method, as the fuel composition is being extruded, the extrudate pulls a ribbon of non-burning material along with it. The extrudate becomes attached to the non-burning ribbon by bonding thereto during the drying process. In especially preferred embodiments, at least a portion of the ribbon extends beyond the periphery of the fuel element, thereby allowing the exposed ribbon portion(s) to lock into any insulating jacket or other overwrap employed around the periphery of the fuel element.

As used herein, the term "carbonaceous" means comprising primarily carbon.

All percentages given herein are by weight, and all weight percentages given herein are based on the final composition weights, unless otherwise noted.

BRIEF DESCRIPTION OF THE DRAWINGS

FIGS. 2–4 illustrate the end view of three preferred fuel element designs prepared according to this invention, showing some of the patterns available under the teachings of this invention.

FIGS. 5–7 illustrate some of the various physical shapes useful herein for the ribbon-like noncombustible retaining member in the fuel element.

DETAILED DESCRIPTION OF PREFERRED EMBODIMENTS

Figure 1:
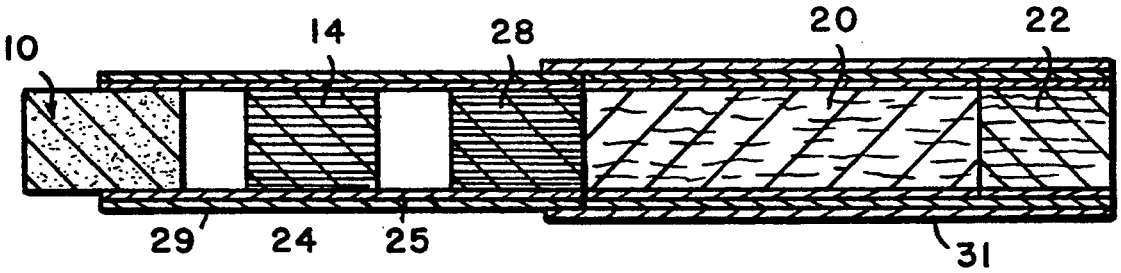
FIG. 1 illustrates in sectional view, one embodiment of a cigarette incorporating a fuel element prepared in accordance with the present invention.
Figure 1A:
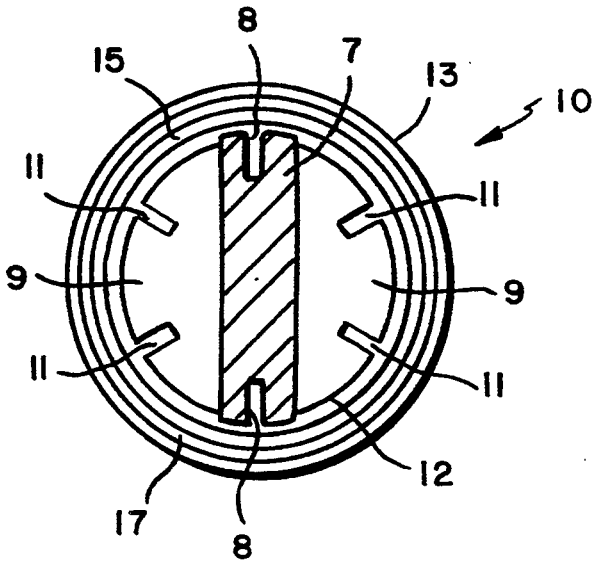
FIG. 1A is an end view of the cigarette shown in FIG. 1.

As described above, the present invention is particularly directed to improvements in carbonaceous fuel elements useful in smoking articles. FIGS. 1 and 1A illustrate a preferred embodiment of a cigarette employing a fuel element of the present invention.

As illustrated in FIG. 1 and more particularly in FIG. 1A, the fuel element 10 comprises two distinct portions, the combustible carbonaceous material 9, which includes a number of peripheral grooves 11 running along its longitudinal axis, and the non-burning heat exchange material 7 which runs longitudinally from end to end, and extends slightly beyond the periphery of the combustible segments 9 of the fuel element 10. As illustrated, the noncombustible component of the fuel element 10 may also include one or more peripheral grooves 8, if desired.

An insulating jacket surrounds the periphery of the fuel element and in the illustrated embodiment comprises alternating layers of glass fibers and tobacco paper, arranged as concentric rings emanating outwardly from the fuel element in the following order; (a) glass fiber mat 12; (b) tobacco paper 15; and (c) glass fiber mat 17; and an outer paper wrapper 13. As illustrated, the noncombustible heat exchange material 7 extends into the insulating jacket, thereby providing a permanent means for retaining the fuel element therein. The outer paper wrapper 13 may comprise one layer or may be prepared from a plurality of separate layers, each having different porosity and ash stability characteristics.

Situated behind and spaced slightly apart from the insulated fuel element 10, is an aerosol generating means, which includes substrate 14. In this embodiment, the substrate is preferably a heat-stabilized paper, treated with one or more hydrated salts, and which further contains one or more aerosol forming materials and/or flavorants. The substrate 14 is overwrapped with a paper overwrap 24 which advantageously is treated (e.g., coated) to prevent migration of the aerosol forming materials.

Spaced longitudinally behind, and, preferably spaced slightly apart from substrate 14, is a segment of tobacco paper 28. This tobacco paper generally provides tobacco flavors to the aerosol emitted from the aerosol generating means. Tobacco segment 28 can be omitted if desired and a void space substituted therefor. Paper overwrap 25 combines the aerosol generating means with the tobacco paper segment. This overwrap may also be treated to prevent migration of the aerosol forming materials.

Circumscribing the insulated fuel element, at a point about 2 to 8 mm from the lighting end of the cigarette, and combining it with the combined substrate/tobacco paper segment to form a front end assembly is a non-burning or foil-backed (e.g., aluminum or other metal) paper wrapper 29. Wrapper 29 is preferably a non-wicking material which prevents transfer of the aerosol forming materials on the substrate 14 to the fuel element 10, the insulating jacket, and/or from staining of the other components of the front end assembly. This wrapper also minimizes or prevents peripheral air (i.e., radial air) from flowing to the portion of the fuel element disposed longitudinally behind its forward edge, thereby causing oxygen deprivation and preventing excessive combustion.

Positioned at the mouth end of the cigarette is a two part mouthend piece comprising (i) a rod or roll of tobacco 20, such as tobacco cut filler and (ii) a low-efficiency filter element 22. A tipping paper 31 is used to join the mouthend piece to the frontend assembly.

In another preferred embodiment, the jacketed fuel element is shortened so that only the required amount of burnable carbonaceous material is provided for the generation of a predetermined number of puffs. In such an embodiment, the outer wrapper 29 preferably extends to the forward end of the jacketed fuel element. Wrapper 29 is thus designed with an appropriate porosity to permit the carbonaceous fuel to obtain the air needed for burning of all of the carbonaceous material while having sufficient cohesiveness after burning to remain intact, to hold the jacketed fuel element on the cigarette. Such papers are described in U.S. Pat. No. 4,938,238.

FIGS. 2–4 illustrate various fuel element front end configurations, wherein the non-burning retainer material is represented by reference numeral 7. Optional peripheral slots in the non-burning material are signified by reference numeral 8. As in FIG. 1A, the combustible portions of the fuel element are identified as reference numeral 9, and the optional peripheral slots or passageways shown therein are signified by reference numeral 11.

FIGS. 5–7 illustrate some of the various physical shapes useful herein for the ribbon-like non-burning retaining member in the fuel element. In FIG. 5, the non-burning ribbon material has a waving (or undulating) configuration. In FIG. 6, the ribbon is provided with a saw tooth configuration. In FIG. 7, a flat, straight ribbon is illustrated. In each of FIGS. 5–7, optional holes 5 are shown. These holes are provided to allow the combustible carbonaceous fuel composition to pass through during the extrusion process in which the fuel element is formed, thereby locking the non-burning ribbon material in the burnable portion of the fuel element.

The fuel elements employed herein should meet three criteria; (1) they should be easy to ignite, (2) they should supply enough heat to produce aerosol for about 5–15, preferably about 8–12 puffs; and (3) they should not contribute off-taste or unpleasant aromas to the cigarette. The combustible portion of the fuel elements of the present invention typically comprises carbon and a binder, or carbon, tobacco and a binder, but other combustible carbonaceous compositions may be used.

The preferred fuel elements of the present invention are designed to provide only the heat required to generate a desired amount of aerosol. Preferably there is no waste of fuel or waste of heat generated during the burning of the fuel. In addition, there is no excess fuel which could be used to overheat the substrate or other components of the cigarette. The fuel elements of the present invention thus provide an ideal energy source for the cigarettes in which they are employed. In the cigarettes of the present invention, the fuel element is designed to generate the calories required for aerosol generation, with minimal heat loss to other components or to the atmosphere.

The inclusion of a non-burning retaining means in the fuel element provides a means for reducing the amount of carbon required to be burned. This is particularly advantageous in that only the amount of combustible fuel necessary to form aerosol for the desired number of puffs need be used. Another advantage of using only the amount of combustible carbon needed to form the desired amount of aerosol is that as the amount of burned carbon is reduced, and the carbon monoxide generated during combustion is also reduced.

The following table illustrates the beneficial reduction in carbon monoxide levels, as determined for fuel elements of the present invention verses a previously employed fuel element design.

TABLE

Figure 10:
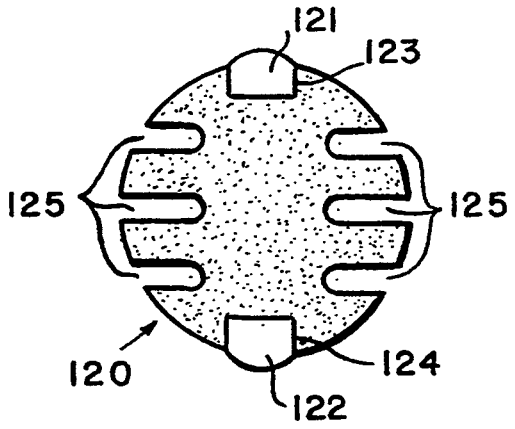
FIG. 10 illustrates a cross section of another preferred structure for a fuel element of the present invention.

| DATA | REFERENCE FUEL | FIG. 2 FUEL | FIG. 3 FUEL | FIG. 10 FUEL |
|---|---|---|---|---|
| Carbon Burned (mg) | 85 | 88 | 58 | 78 |
| $CO_2$ (mg) | 87 | 82 | 63 | 68 |
| CO (mg) | 22 | 16 | 12 | 17 |
| Calories | 207 | 190 | 146 | 160 |
| CO/cal. | 0.105 | 0.082 | 0.080 | 0.105 |
| Calories to substrate | 27.4 | 21.8 | 23.2 | — |

In the Table, the "Reference Fuel" is substantially that fuel element described herein in Reference Example 1. The "FIG. 2 Fuel" fuel is described herein in Example 2. The "FIG. 3 Fuel" fuel is described herein in Example 3. The "FIG. 10 Fuel" fuel is described herein in Example 4. The data reflected in the Table were all obtained under machine smoking conditions of 50 cc puff volume of 2 seconds duration, separated by 28 seconds of smolder time (hereinafter 50/30 smoking conditions), for a total of 20 puffs.

The density of the burnable carbonaceous portion of the preferred fuel elements is generally greater than about 0.5 g/cc, preferably greater than about 0.7 g/cc and most preferably greater than about 1 g/cc, but typically does not exceed 2 g/cc.

When a coextruded portion is employed as the non-burnable heat exchange portion of the fuel element, the most important factor is typically the thickness of the material used, as well as its ability to conduct heat. Coextruded non-burning segments having a thickness of from about 0.02 inch to about 0.04 inch have proven very effective as heat exchangers herein.

The overall length of the fuel element, prior to burning, is generally less than about 20 mm, often less than about 15 mm, and is typically less than 12 mm. The overall outside diameter of the fuel element is typically less than about 8 mm, advantageously less than about 6 mm and is typically about 4.5 mm.

As described above, at least two processes are currently preferred for the generation of fuel elements containing a non-burnable heat exchange material—the "ribbon pull" method and coextrusion. In the first method, the ribbon pull, a ribbon-like metal or metal-like material is fed to an extruder, and is coated therein with an extruded carbonaceous fuel composition. The resulting continuous rod having a ribbon in the center is then dried and cut to length as desired. The "ribbon pull" method is illustrated in FIG. 8.

The metal or metal-like ribbon can be made from any convenient material, e.g., a thin metal foil, such as stainless steel, aluminum, copper, and the like. Suitable metal-like ribbon materials are materials which have a high heat conduction capacity, such as Grafoil, available from Union Carbide Corp. The foil material can have any desired shape or configuration. See FIGS. 5–7. Typically, the foil has a thickness of from about 0.002 to about 0.02, preferably from about 0.005 to about 0.015, and most preferably about 0.010 inches. The width of the foil is typically from about 0.15 to about 0.22, preferably from about 0.16 to about 0.2, and most preferably about 0.18 inches. If desired, holes, about 0.04 to about 0.1, preferably about 0.06 to about 0.09, most preferably about 0.07 inches in diameter are provided in the foil. These holes are typically provided every ¼ inch, preferably every 3/16 inch, most preferably every ⅛ inch, so that the carbonaceous extrudate can lock the ribbon in place.

Figure 8:
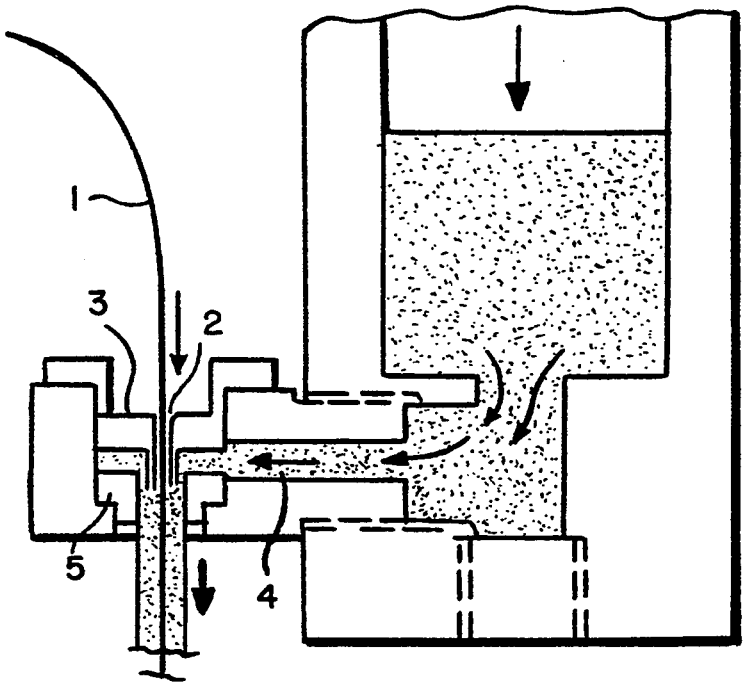
FIG. 8 illustrates one preferred process for preparing fuel elements of the present invention, the "ribbon pull" method.

As illustrated in FIG. 8, a non-burnable ribbon material 1 is fed into the back of feed tube 2 and through the back extrusion die 3. Here the ribbon (e.g., graphite foil) is pulled through the burnable carbonaceous fuel composition that is fed into the die assembly through a side port in the die holding unit. The carbonaceous material is fed through feed holes 4 in the back die 3. The carbonaceous material is formed into fuel element rods having the desired slot or hole pattern determined by the front die 5'. Line speed is controlled by the velocity control on the extrusion press. The extrusion of the carbonaceous fuel element rods causes the ribbon to be pulled along through the slot in the back die 3, thereby embedding the ribbon 1 in the extrudate.

In the second preferred method, the coextrusion method, two extrudable mixtures are prepared, one comprising the combustible carbonaceous fuel composition, the other comprising a non-burning composition, e.g., a graphite. Binders typically employed in the formation of extruded fuel compositions may be employed in both extrusion mixtures. One preferred binder for use in this process is carboxymethylcellulose (CMC).

The combustible fuel compositions useful herein may be any of those carbonaceous fuel compositions described in the patents recited in the Background of the Invention, supra. Preferred carbonaceous fuel compositions are described in copending application Ser. No. 07/722,993, filed June 28, 1991, the disclosure of which is hereby incorporated herein by reference. They generally comprise burnable carbonaceous fuel, a binder, sufficient water to provide the consistency of a workable paste (generally 32–40% by weight), and various other materials to provide desired characteristics.

The non-burning composition useful herein generally comprises from about 5 to 90 weight percent of a graphite having a density of about 1.3–1.9 g/cc. Other non-burning ingredients may also be used, e.g., non-burning fillers such as $CaCO_3$, clays such as bentonite, and the like. When fillers or extenders are used with graphite, they may contribute up to about 80 weight percent of the mixture, preferably from about 10 to about 60 percent, and most preferably about 40 percent of the non-burning composition. A binder is typically used to hold the non-burning composition together. Preferred binders include CMC, SCMC, sodium alginate, etc. The compositions are extruded from mixes containing sufficient water to provide the consistency of a workable paste, generally about 32–40% water by weight.

In the coextrusion process, at least two extruders feed a common die, such that the extrudates create the desired placement of the non-burning composition within the burning fuel rod. The shapes and sizes of the two (or more) components can be varied as desired. The resulting continuous rod having a non-burning portion located therein is then dried and cut to length as desired. A coextrusion die is illustrated in FIG. 9.

Figure 9:
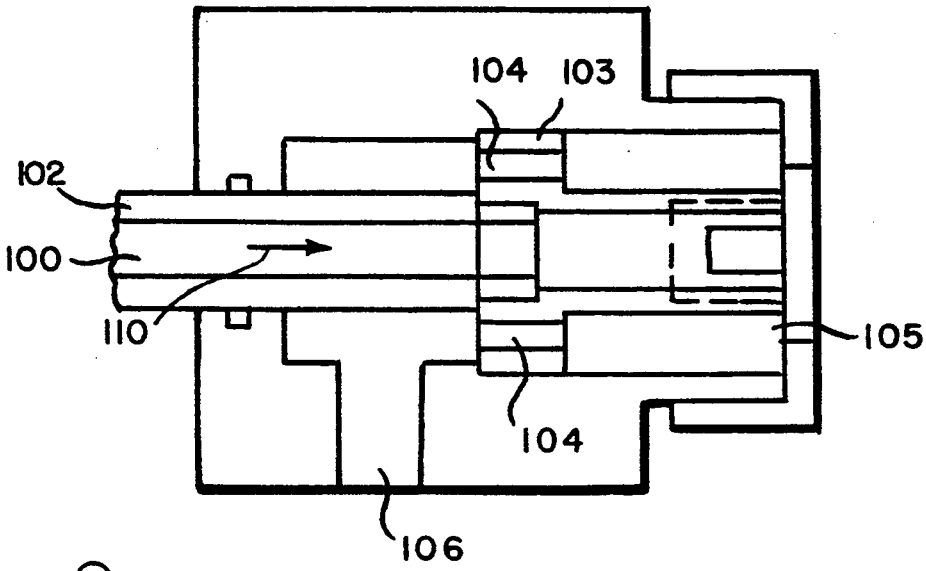
FIG. 9 illustrates another preferred process for preparing fuel elements of the present invention, particularly the longitudinal coextrusion process.
Figure 9A:
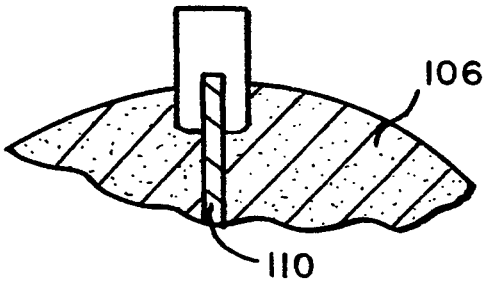
FIG. 9A is a schematic sectional drawing depicting a section through the device of FIG. 9.

As illustrated in FIGS. 9 and 9A, one coextrusion process involves feeding the non-burning material 110 into the feed tube 102. The feed tube 102 feeds the non-burning material into the back die 103 and the material is formed into a strip. The burnable carbonaceous 106 composition is fed into the die assembly through a side port in the die holding unit and fed through feed holes 104 in the back die 103. The carbonaceous material 106 and non-burning material 100 are formed into fuel rods having the desired slot or hole pattern dictated by the front die 105.

The fuel element 120 shown in cross section in FIG. 10 has two non-burning sections, 121 and 122 which are extruded into corresponding slots 123 and 124 formed during extrusion of the burnable carbon fuel body. The fuel has a plurality of grooves 125 which aid in lighting the fuel and in heat transfer characteristics of the fuel. When the fuel element burns, the non-burning portions remain. In a cigarette, the last portion, e.g. 6 mm, of the fuel is circumscribed by a layer having little or no air permeability, and which could conduct very substantial amounts of heat away from the fuel. Such structures cause the segment of burnable carbon located between the non-burnable portions 121 and 122 to extinguish, so that a plug of unburned but burnable carbonaceous fuel remains between the non-burnable portions 121 and 122 over the last few millimeters of the fuel element. In such an embodiment, the amount of burnable fuel which remains after extinguishing of the cigarette is controlled.

Figure 11:
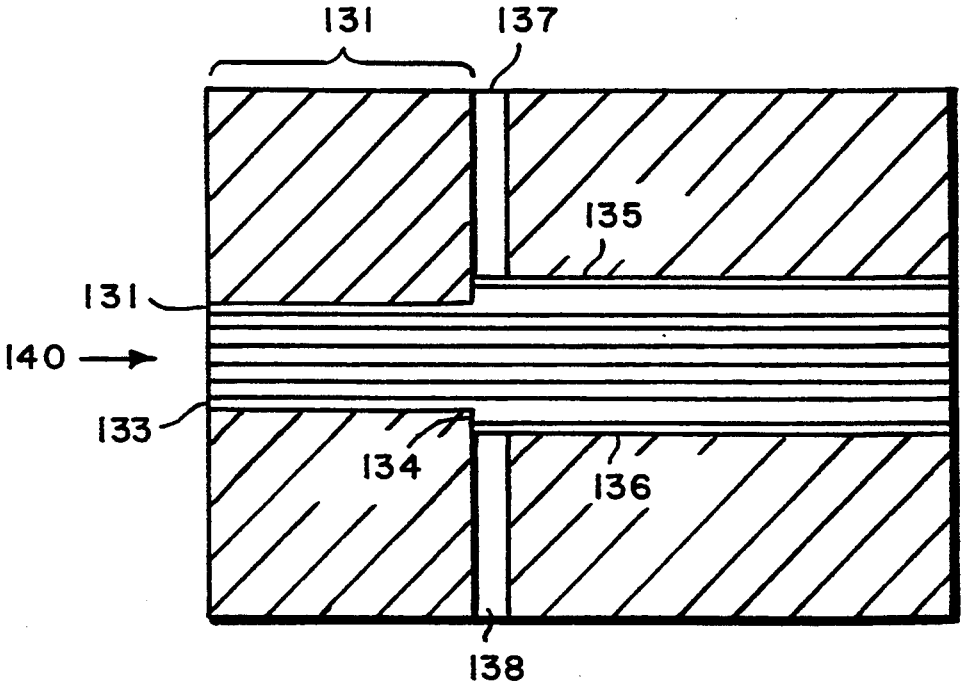
FIG. 11 illustrates, partially in section, the structure of an extrusion die for use in a coextrusion process for manufacturing the fuel element illustrated in FIG. 10.

A preferred device for producing the structure of FIG. 10 is shown in FIG. 11. The extrusion die 130 has a first forming segment 131, which corresponds to the shape of the burnable carbonaceous fuel, including protrusions 132 and 133 which form the slots 123 and 124 in the fuel element (FIG. 10), and protrusions (not shown) which form the grooves 125 in the finished fuel element. The first forming segment terminates at point 134, at which point channels 135 and 136 are provided to form the non-burning portions in the slots 121 and 122, where they contact the burnable carbonaceous fuel body. The non-burning material is supplied to channels 135 and 136 via passageways 137 and 138, respectively, which preferably are maintained at constant pressure, so that the supply of non-burnable material to slots 135 and 136 remains relatively constant. The non-burning material remains in the finished product, and protrudes from the upper and lower circumference of the burnable fuel body, as shown in FIG. 10. Those protruding non-burning portions make solid contact with the circumscribing insulating material, and thus aide in retaining the fuel element in the smoking article throughout smoking.

When employed in a cigarette, the fuel element is advantageously circumscribed by an insulating and/or retaining jacket material. The insulating and retaining material preferably (i) is adapted such that drawn air can pass therethrough, and (ii) is positioned and configured so as to hold the fuel element in place. Preferably, the jacket is flush with the ends of the fuel element, however, it may extend from about 0.5 mm to about 3 mm beyond each end of the fuel element.

The components of the insulating and/or retaining material which surrounds the fuel element can vary. Examples of suitable materials include glass fibers and other materials as described in U.S. Pat. No. 5,105,838; European Patent Publication No. 336,690; and pages 48–52 of the RJR Monograph, supra. Examples of other suitable insulating and/or retaining materials are glass fiber and tobacco mixtures such as those described in U.S. Pat. Nos. 5,105,838, 5,065,776 and No. 4,756,318; and U.S. patent application Ser. No. 07/354,605, filed May 22, 1989.

Other suitable insulating and/or retaining materials are gathered paper-type materials which are spirally wrapped or otherwise wound around the fuel element, such as those described in copending U.S. patent application Ser. No. 07/567,520, filed Aug. 15, 1990. The paper-type materials can be gathered or crimped and gathered around the fuel element; gathered into a rod using a rod making unit available as CU-10 or CU20S from DeCoufle s.a.r.b., together with a KDF-2 rod making apparatus from Hauni-Werke Korber & Co., KG, or the apparatus described in U.S. Pat. No. 4,807,809 to Pryor et al.; wound around the fuel element about its longitudinal axis; or provided as longitudinally extending strands of paper-type sheet using the types of apparatus described in U.S. Pat. No. 4,889,143 to Pryor et al. and U.S. Pat. No. 5,025,814 to Raker, the disclosures of which are incorporated herein by reference.

If desired, the fuel element 10 may be extruded into the insulating jacket material as set forth in U.S. patent application Ser. No. 07/856,239, filed Mar. 25, 1992, the disclosure of which is incorporated herein by reference.

Examples of paper-type sheet materials are available as P-2540-136-E carbon paper and P-2674-157 tobacco paper from Kimberly-Clark Corp.; and preferably the longitudinally extending strands of such materials (e.g., strands of about 1/32 inch width) extend along the longitude of the fuel element. The fuel element also can be circumscribed by tobacco cut filler (e.g., flue-cured tobacco cut filler treated with about 2 weight percent potassium carbonate). The number and positioning of the strands or the pattern of the gathered paper is sufficiently tight to maintain, retain or otherwise hold the composite fuel element structure within the cigarette.

As illustrated in FIGS. 1 & 1A, the insulating jacket which surrounds the fuel element is circumscribed by a paper wrapper. Suitable papers for use herein are described in U.S. Pat. No. 4,938,238 and U.S. patent application Ser. No. 07/574,327, filed Aug. 28, 1990.

As described above, the substrate carries aerosol forming materials and other ingredients, e.g., flavorants and the like, which, upon exposure to heated gases passing through the aerosol generating means during puffing, are vaporized and delivered to the user as a smoke-like aerosol. Preferred aerosol forming materials used herein include glycerin, propylene glycol, water, and the like, flavorants, and other optional ingredients. The patents referred to in the Background of the Invention (supra) teach additional useful aerosol forming materials that need not be repeated here.

The substrate rods are advantageously formed using commercially available equipment, particularly cigarette filter making equipment, or cigarette rod forming equipment. Two preferred commercially available apparatus useful in forming the substrates of the present invention are the DeCoufle filter making equipment (CU-10 or CU20S) available from DeCoufle s.a.r.b. and a modified rod forming apparatus, the KDF-2, available from Haunie-Werke Korber & Co., KG.

In most embodiments of the present invention, the combination of the fuel element and the substrate (also known as the front end assembly) is attached to a mouthend piece; although a disposable fuel element-/substrate combination can be employed with a separate mouthend piece, such as a reusable cigarette holder. The mouthend piece provides a passageway which channels vaporized aerosol forming materials into the mouth of the smoker; and can also provide further flavor to the vaporized aerosol forming materials. Typically, the length of the mouthend piece ranges from 40 mm to about 85 mm.

Flavor segments (i.e., segments of gathered tobacco paper, tobacco cut filler, or the like) can be incorporated in the mouthend piece or the substrate segment, e.g., either directly behind the substrate or spaced apart therefrom, to contribute flavors to the aerosol. Gathered carbon paper can be incorporated, particularly in order to introduce menthol flavor to the aerosol. Such papers are described in European Patent Publication No. 432,538. Other flavor segments useful herein are described in U.S. patent application Ser. No. 07/414,835, filed Nov. 29, 1989, Ser. No. 07/606,287, filed Nov. 6, 1990, and Ser. No. 07/621,499, filed Dec. 7, 1990.

The present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius.

EXAMPLE 1

Reference Fuel Element

A reference fuel element, i.e., a non-composite fuel element, is prepared as follows:

A fuel element 12 mm long and 4.5 mm in diameter, and having an apparent (bulk) density of about 1.02 g/cc is prepared from about 82.85 parts hardwood pulp carbon having an average particle size of 12 microns in diameter, 10 parts ammonium alginate (Amoloid HV, Kelco Co.), 0.9 parts $Na_2CO_3$, 0.75 parts levulinic acid, 5 parts, ball-milled American blend tobacco and 0.5 parts tobacco extract, obtained as described in U.S. patent application Ser. No. 07/710,273, filed Jun. 9, 1991.

The hardwood pulp carbon is prepared by carbonizing a non-talc containing grade of Grande Prairie Canadian kraft hardwood paper in an inert atmosphere, increasing the temperature in a step-wise manner sufficient to minimize oxidation of the paper, to a final carbonizing temperature of at least 750° C. The resulting carbon material is cooled in the inert atmosphere to less than 35° C., and then ground to fine power having an average particle size (as determined using a Microtrac Analyzer, Leeds & Northrup) of about 12 μm in diameter.

The finely powdered hardwood carbon is dry mixed with the ammonium alginate binder, levulinic acid and the tobaccos, and then a 3% wt. aqueous solution of $Na_2CO_3$ is added to provide an extrudable mixture, having a final sodium carbonate level of about 0.9 parts.

Fuel rods (each about 24 inches long) are extruded using a screw extruder from the mixture having a generally cylindrical shape about 4.5 mm in diameter, with six (6) equally spaced peripheral grooves (about 0.5 mm wide and about 1 mm deep) with rounded bottoms, running from end to end. The extruded rods have an initial moisture level ranging from about 32–34 weight percent. They are dried at ambient temperature for about 16 hours and the final moisture content is about 7–8 weight percent. The dried cylindrical rods are cut to a length of 12 mm using diamond tipped steel cutting wheels.

EXAMPLE 2

Coextrusion Method

An extrudable non-burning composition is prepared comprising a 1:1 (by weight) mixture of $CaCO_3$ and graphite having a density of 1.3 together with 8 parts CMC binder and sufficient water added to give a workable paste, in this case about 35% by weight.

An extrudable burnable carbonaceous fuel composition comprising 10 weight percent CMC binder, 90 weight percent carbon having an average particle size (Microtrac) of 12 μm and about 38% water is prepared.

The non-burning composition is fed into a feed tube which feeds the non-burning material into a back die to form the composition into a strip. The burnable carbonaceous fuel composition is fed into the die assembly through a side port in the die holding unit and fed through feed holes in the back die. The burnable carbonaceous material and the non-burning material thereby become integral in the desired configuration, and exit the die at the front end as fuel rods having the desired diameter and slot or hole pattern dictated by the front die. The resulting 4.5 mm diameter rods are air dried and cut into fuel element lengths (12 mm). They have the cross sectional configuration depicted in FIG. 2. The graphite non-burning segment has a thickness of 0.22 inches, and the depicted grooves have a width of 0.018 inches and terminate in radiuses of 0.09 inch. The grooves have a depth of about 0.04 inches at their deepest point. The diameter of the graphite non-burning segment was about 4.9 mm.

EXAMPLE 3

Ribbon-Pull Method

An extrudable combustible carbonaceous fuel mixture is formed with 10 weight percent CMC binder, 90 weight percent of carbon having an average particle size (Microtrac) of 12 μm, and water up to 38% based on solids.

A graphite foil ribbon 0.010 inches (0.254 mm) thick by 0.200 inches (5.08 mm) wide, having 0.080 inch (2.032 mm) diameter holes punched every ⅛ inch (3.175 mm) is fed into the back of an extrusion feed tube and through the back of an extrusion die. The ribbon is then pulled through the burnable carbonaceous fuel composition that is fed into the die assembly through a side port in the die holding unit. The carbonaceous material is simultaneously fed through feed holes in the back die. The carbonaceous material, surrounding the foil ribbon, is formed into continuous fuel element rods having the desired diameter and slot or hole pattern, as determined by the size and shape of the front die. Line speed is controlled by the velocity control on the extrusion press. The extrusion of the carbonaceous fuel element rod causes the ribbon to be pulled along through the slot in the back die, thereby embedding the ribbon in the extrudate.

The 4.5 mm diameter composite ribbon containing fuel rod is air dried and cut into appropriate fuel element lengths (12 mm).

EXAMPLE 4

Coextrusion Method

An extrudable non-burning composition is prepared comprising a 1:1 (by weight) mixture of $CaCO_3$ and graphite having a density of 1.3 together with 8 parts CMC binder and sufficient water added to give a workable paste, in this case about 33% by weight.

An extrudable burnable carbonaceous fuel composition comprising 10 weight percent CMC binder, 90 weight percent carbon having an average particle size (Microtrac) of 12 μm and about 37% water is prepared.

The burnable carbonaceous fuel composition is fed into the die assembly depicted in FIG. 11, through a port in the end of the die. The non-burning composition is fed into a feed tube which feeds the non-burning material into tubes 137 and 138. The non-burning material is formed into two non-burning portions or segments 121 and 122, by the shape of passageways 135 and 136. The non-burning material contacts the burnable carbonaceous fuel along the bottom and sides of slots 123 and 124. The burnable carbonaceous material and the non-burning material thereby become integral in the desired configuration, and exit the die at the front end as fuel rods having the desired diameter and slot or hole pattern dictated by the front die. The resulting 4.2 mm diameter rods are air dried and cut into fuel element lengths (12 mm). They have the cross sectional configuration depicted in FIG. 10. The graphite non-burning segments have a height of 0.025 inches, and protrude above the surface of the burnable rod 0.2 mm. The protruding part of the non-burning sections have the shape of an arc of a right cylinder having a radius of 0.03 inches. The base of the non-burning portions is 0.04 inches in width. The depicted grooves have a width of 0.016 inches and terminate in radiuses of 0.08 inch. The grooves all terminate at a point about 0.037 inches from the vertical axis of the element as depicted, and the grooves are spaced apart about 0.041 inch, center line to center line.

EXAMPLE 5

Burn Characteristics

Burning characteristics of fuel elements are determined using the Phoenix Precision Instruments Model JM-6500 aerosol spectrometer, available from the Virtis Company, Gardiner, N.Y., modified as described in copending application Ser. No. 07/882,209, filed May 13, 1992, the disclosure of which is hereby incorporated herein by reference.

The modified JM-6500 instrument provides measurements of total carbon dioxide, total carbon monoxide, and total calories generated during the burning of the fuel elements. The instrument also provides a puff-by-puff analysis of those data.

For each example, five fuel elements are jacketed and smoked using the modified JM-6500 instrument for 20 puffs under 50/30 smoking conditions. These conditions consist of a 50 ml puff volume of two seconds duration, separated by 28 seconds of smolder time. Lighting of the fuel elements was by application of a standard lighter flame to the face of the fuel elements for five seconds duration before drawing the first puff under 50/30 smoking conditions.

The results obtained for the reference fuel element of Example 1 are as follows:

| | |
|---|---|
| Average Total $CO_2$ | 87 mg |
| Average Total CO | 22 mg |
| Average Total Calories | 209 |
| Average CO/Calories | 0.105 |

The results obtained for the coextruded fuel elements of Example 2 are as follows:

| | |
|---|---|
| Average Total $CO_2$ | 82 mg |
| Average Total CO | 16 mg |
| Average Total Calories | 190 |
| Average CO/Calories | 0.082 |

The results obtained for the ribbon-pull fuel elements of Example 3 are as follows:

| | |
|---|---|
| Average Total $CO_2$ | 63 mg |
| Average Total CO | 12 mg |
| Average Total Calories | 146 |
| Average CO/Calories | 0.080 |

The results obtained for the coextruded fuel elements of Example 4 are as follows:

| | |
|---|---|
| Average Total $CO_2$ | 68 mg |
| Average Total CO | 17 mg |
| Average Total Calories | 160 |
| Average CO/Calories | 0.105 |

EXAMPLE 6

Cigarette

Fuel Element

A fuel element prepared as in Example 2, 3 or 4 is employed. The length of the fuel element is 12 mm and the diameter is 4.5 mm in the case of examples 2 and 3, and 4.2 mm in the case of Example 4.

Insulating Jacket

A 12 mm long, 4.5 mm diameter plastic tube is overwrapped with an insulating jacket material that is also 12 mm in length. In these cigarette embodiments, the insulating jacket is composed of 2 layers of Owens-Corning C-glass mat, each about 1 mm thick prior to being compressed by a jacket forming machine (e.g., such as that described in U.S. Pat. No. 4,807,809), and after formation, each being about 0.6 mm thick. Sandwiched between the two layers of C-glass is one sheet of reconstituted tobacco paper, Kimberly-Clark's P-2831-189-AA. A cigarette paper, designated P-3122-153 from Kimberly-Clark, overwraps the outer layer. The reconstituted tobacco paper sheet is a paper-like sheet made from tobacco, additionally containing a blended tobacco extract. The width of the reconstituted tobacco sheets prior to forming are 19 mm for the inner sheet and 26.5 mm for the outer sheet. The final diameter of the jacketed plastic tube is about 7.5 mm.

Substrate

A substrate rod about 7.5 m in diameter is formed from a highly embossed, 36 g/m$^2$, 152 mm wide web of paper containing 25% calcium sulfate available from Kimberly-Clark as P3284-19, e.g., on a modified KDF-2 rod forming apparatus. The substrate rod is overwrapped with Simpson paper RJR-002 which is coated on both sides the Hercon 70. The overwrapped rod is cut into 10 mm segments weighing approximately 55 mg.

Tobacco Paper Plug

A tobacco paper rod about 7.5 mm in diameter is formed from a medium embossed, 127 mm wide web of tobacco paper designated as P-144-GNA-CB available from Kimberly-Clark, e.g., using a rod forming apparatus such as that disclosed in U.S. Pat. No. 4,807,809. The rod is overwrapped with a 26.5 mm wide paper P1487-184-2 from Kimberly-Clark and cut into 10 mm lengths.

Front End Overwrap

A front end overwrap paper is formed by laminating several papers including; an outer layer of Ecusta 456 paper, an intermediate layer of 0.0005 cm foil and an inner layer of tissue paper, 12.5 lbs/ream, 20.4 g/m$^2$. The laminated layers are held together with a commercial adhesive, Airflex 465, using 1.5 lbs/ream.

Aerosol Tube

A paper aerosol tube about 7.5 mm diameter is made from a web of 112 gsm basis weight Simpson RJR-002 paper, about 27 mm wide, having a thickness of about 0.012 inch. The RJR-002 paper is formed into a tube by lap-joining the paper using a water-based ethylene vinyl acetate adhesive. The inner and outer surface of the paper tube is coated with a Hercon-70. The paper is cut into segments 31 mm in length.

Mouth End Tube

A paper mouth end tube about 7.5 mm diameter is formed from Simpson paper, Type 002-A, lap joined using a hot-melt adhesive No. 448-195K, available from the R.J. Reynolds Tobacco Company. The formed tube is cut into 40 mm length segments.

Filter Plug

A polypropylene filter rod about 7.5 mm in diameter is formed from a PP-100 mat, about 260 mm wide, available from Kimberly-Clark and overwrapped with a 26.5 mm wide web of paper P1487-184-2, available from Kimberly-Clark, e.g., using the apparatus described in U.S. Pat. No. 4,807,809. The overwrapped rod is cut into 20 mm length segments.

Tobacco Roll

A reconstituted tobacco cut filler prepared as described in U.S. patent application Ser. No. 07/710,273 filed Jun. 14, 1991, is formed into a rod about 7.5 mm in diameter and overwrapped with paper, e.g., using the apparatus described in U.S. Pat. No. 4,807,809. The overwrapped tobacco roll is cut into 20 mm lengths.

Assembly of Cigarette

A. Front End Piece Assembly

A 10 mm long substrate piece is inserted into one end of the 31 mm long aerosol tube and spaced about 5 mm from the end, thereby forming a void space of about 5 mm. Approximately 150 mg of a mixture comprising glycerin, tobacco extract and other flavors is applied to the substrate. A 10 mm long tobacco paper plug is inserted into the other end of the aerosol tube until the mouth end of the tobacco paper plug is flush with the mouth end of the aerosol tube.

A 12 mm long insulating jacket piece is aligned with the front end of the aerosol tube so that the insulating jacket piece is adjacent the void space in the aerosol tube. The insulating jacket piece and the aerosol tube are circumscribed with a piece of front end overwrap paper, approximately 26.5 mm×37 mm. The tissue paper side of the overwrap paper (supra) is placed toward the aerosol tube and a seam adhesive (2128-69-1) available from the H.B. Fuller Co., Minneapolis, Minn., is used to seal the overlap joint. The 37 mm length of the overwrap is aligned in the longitudinal direction so that the overwrap paper extends from the free end of the aerosol tube to approximately 6 mm over the insulating jacket, leaving approximately 6 mm of the insulating jacket exposed.

The plastic tube in the insulating jacket piece is removed and a 12 mm long fuel element is inserted so that the end of the fuel element is flush with the end of the insulating jacket.

B. Mouthend Piece Assembly

A 20 mm filter plug is inserted into one end of the mouthend tube and a 20 mm tobacco roll inserted into the other end of the mouthend tube so that the plug and roll are flush with the ends of the mouthend tube.

The mouthend piece assembly and the front end piece assembly are aligned so that the tobacco roll abuts the tobacco paper plug and are secured together by a piece of tape to form a cigarette.

The cigarette is smoked, and yields visible aerosol and tobacco flavor (i.e., volatilized tobacco components) on all puffs for about 10–12 puffs. The fuel element burns to about 6 mm back, i.e., to about the region where the foil lined tube overwraps the fuel element, and there the cigarette self-extinguishes.

EXAMPLE 7

Preparation of Components

Jacketed Fuel Rod

A jacketed fuel rod approximately 7.5 mm in diameter, including a fuel element prepared according to any of Examples 2, 3, or 4, and an insulating material is prepared by directly extruding the carbonaceous fuel rod into a multilayer glass fiber/tobacco paper ribbon in accordance with the process described in U.S. patent application Ser. No. 07/856,239, filed Mar. 25, 1992. The jacketed fuel rod is cut into lengths of about 72 mm.

Jacket Material

The jacket material is composed of 2 layers of Owens-Corning C-glass mat, each about 1 mm thick prior to being compressed by a jacket forming machine (e.g., such as that described in U.S. Pat. No. 4,807,809), and after formulation, each being about 0.6 mm thick. Sandwiched between the two layers of C-glass is one or two sheets of reconstituted tobacco paper, Kimberly-Clark's P-3510-96-2. A cigarette paper, designated P-3122-153 from Kimberly-Clark, overwraps the outer layer. The reconstituted tobacco paper sheet, is a paper-like sheet containing a blended tobacco extract. The width of the reconstituted tobacco sheets prior to forming is about 17 mm, while the width of the cigarette paper outer sheet is about 25.5 mm. The seam adhesive used for the outer wrap can be a cold seam adhesive CS 1242, available from RJR Packaging, R.J. Reynolds, Winston-Salem, N.C.

Substrate Tube

A continuous substrate rod about 7.5 mm in diameter is formed from a wide, highly embossed, 36 gsm, about 7 inch wide web of paper containing 25% calcium sulfate available from Kimberly-Clark (KC) as P3284-19, e.g., on a modified KDF-2 rod forming apparatus. The substrate rod is overwrapped with a paper/foil laminate having a width of about 24.5 mm, the foil being a continuous cast 0.0005 aluminum foil, and the paper being a Simpson Paper Co. ("Simpson") RJR 002A paper. The lamination adhesive is a silicate adhesive, No. 06-50-05-0051, available from RJR Packaging. A Center line adhesive, cold adhesive CS 1242M, available from RJR Packaging, is spray applied to the laminate, to hold the substrate in place within the wrap. The seam is sealed with hot melt adhesive 444-227, from RJR packaging.

The overwrapped rod is cut into 60 mm segments. Approximately 900 mg of an aerosol forming material comprising glycerine, propylene glycol, and flavorants, such as tobacco extract, is applied to the web during formation of the continuous substrate rod. The substrate segment is cut into substrate plugs about 10 mm in length and overwrapped with a Simpson RJR 002A/0005 foil laminate described above, having a width of about 25.5 mm. The plugs are placed at alternate intervals of 10 and 12 mm along the tube. The plugs are adhered to the tube by corresponding application of hotmelt adhesive No. 448-37A, RJR Packaging. The seam is sealed with hot melt adhesive 444-227, from RJR packaging.

The continuous tube is cut into substrate void tube sections about 42 mm in length having a center void about 12 mm, two substrate plugs 10 mm wide, and void space at each end of about about 5 mm in width.

Tobacco Section

A reconstituted tobacco cut filler prepared as described in U.S. patent application No. 07/710,273 filed Jun. 14, 1991, is formed into a rod about 7.5 mm in diameter and overwrapped with paper, e.g. KC 646, 25.5 mm in width, using a Protos cigarette making machine, using a standard tipping adhesive. The overwrapped tobacco roll is cut into 120 mm length segments.

A tobacco paper rod about 7.5 mm in diameter is formed from a medium embossed, 127 mm wide web of tobacco paper designated as P-144-GNA-CB available from Kimberly-Clark, e.g., using a rod forming apparatus such as that disclosed in U.S. Pat. No. 4,807,809. The rod is overwrapped with a KC paper P1487-184-2, about 25 mm wide, and cut into 80 mm length segments.

The tobacco roll and tobacco paper segments are cut into 40 mm and 20 mm segments respectively and are aligned in an alternating arrangement and overwrapped with a wrapper of KC 646 paper, 25.5 mm in width, using a center line hot melt adhesive 448-37A, RJR Packaging, and a seam adhesive, 448-195K hot melt, RJR Packaging. The combined tobacco roll/tobacco paper assembly is cut into a 2-up tobacco section 60 mm in length having a 40 mm tobacco roll center segment and 10 mm tobacco paper segment on each end of the tobacco roll segment.

Filter

A polypropylene filter rod about 7.5 mm in diameter is formed from a PP-100 mat, about 260 mm wide, available from Kimberly-Clark and overwrapped with a web of paper P1487-184-2, having a width of 25.5 mm, available from Kimberly-Clark, e.g., using the apparatus described in U.S. Pat. No. 4,807,809, and hot melt 448-195K seam adhesive. The overwrapped rod is cut into 80 mm length segments.

Cigarette Assembly

Fuel Substrate Section

A jacketed fuel rod is cut into fuel elements 12 mm in length. Two fuel elements are positioned on opposite sides of a substrate void tube section and aligned. These components are overwrapped with a wrapper about 26.5 mm in width and about 54 mm in length, comprising a paper/foil/paper laminate, comprising Ecusta 15456 paper/continuous cast 0.0005 foil/Ecusta 29492 paper, which are laminated to the foil using Airflex Adhesive 465. The laminate is adhered to the jacketed fuel and the substrate void tube assembly, by cold adhesive MT-8014, RJR Packaging, applied to the entire inner surface of the laminate. The wrapper overwraps the substrate tube and extends to within about 6 mm of the free end of each fuel element to form a 2-up fuel substrate section.

Tobacco Fuel Unit

A 2-up fuel/substrate section is cut at its midpoint and positioned on opposite sides of a 2-up tobacco section and aligned so that the void end of each fuel-substrate section is adjacent and abuts the tobacco paper plugs at each end of the 2-up tobacco section. The assembled components are overwrapped with Ecusta E30336 paper, about 70 mm in length and about 26 mm wide. The wrapper is adhered to the fuel substrate section and the tobacco section assembly with MT-8009 adhesive (RJR Packaging) to form a 2-up tobacco-fuel unit approximately 126 mm in length.

Cigarette

A 2-up tobacco-fuel unit is cut at its midpoint and positioned on opposite sides of a 2-up filter unit and aligned so that the tobacco roll end of a single tobacco-fuel unit is adjacent and abuts the 2-up filter. The assembled components are overwrapped with a tipping wrapper, RJR tipping code No. 1000011, approximately 50 mm in length and about 26 mm in width which extends approximately 5 mm over each of the junctures between the 2-up filter and each tobacco-fuel unit. The wrapper is adhered over its entire area to the assembled components with an adhesive MT-8009 (RJR Packaging) 100% coverage, to form a 2-up cigarette. The 2-up cigarette is cut at approximately its midpoint (i.e., the midpoint of the 2-up filter) to form a single cigarette.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A composite fuel element for smoking articles comprising at least two integral but distinct component materials, said component materials being contiguous throughout the length of the composite fuel element, and wherein said component materials include a carbonaceous material which burns, and a material situated substantially within the periphery of the carbonaceous material which does not burn significantly when compared to the burning material, and wherein said fuel element has a length of less than about 20 mm before burning.

2. The composite fuel element of claim 1, wherein at least a portion of said non-burning material extends beyond the periphery of said burnable material.

3. The composite fuel element of claim 1, wherein the non-burning material included in the fuel element comprises a heat exchange material.

4. The composite fuel element of claim 3, wherein the heat exchange material comprises a non-burning carbon.

5. The composite fuel element of claim 3, wherein the heat exchange material comprises a graphite foil.

6. The composite fuel element of claim 3, wherein the heat exchange material comprises a metal ribbon or foil.

7. A composite fuel element for smoking articles comprising at least two different materials, contiguous throughout the length thereof, including a carbonaceous material which burns, and a material which does not burn significantly when compared to the burning material, wherein said fuel element has a length of less than about 20 mm before burning, and wherein the nonburning material comprises a plurality of segments of non-burning material.

8. The carbonaceous fuel element of claim 1, 2, 3, 7, or 4, wherein the non-burning material further comprises one or more binders.

9. An extruded composite fuel element for smoking articles comprising at least two coextruded materials contiguous throughout the length thereof, including a carbonaceous material which burns, and a carbonaceous heat exchange material which does not burn significantly when compared to the burning material, wherein said non-burning material is situated substantially within the periphery of the carbonaceous material and wherein said fuel element has a length of less than about 20 mm before burning.

10. The extruded composite fuel element of claim 9, wherein at least a portion of said heat exchange material extends beyond the periphery of said burnable material.

11. The extruded composite fuel element of claim 10, wherein the heat exchange material in the fuel element comprises a carbon.

12. An extruded composite fuel element for smoking articles comprising at least two materials contiguous throughout the length thereof, including a carbonaceous material which burns, and a metal heat exchange material which does not burn, wherein said non-burning material is situated substantially within the periphery of the carbonaceous material and wherein said fuel element has a length of less than about 20 mm before burning.

13. The extruded composite fuel element of claim 12, wherein at least a portion of said metal heat exchange material extends beyond the periphery of said burnable material.

14. The extruded composite fuel element of claim 12, wherein the metal heat exchange material has the form of a ribbon or foil.

15. A cigarette comprising:

a carbonaceous fuel element less than about 20 mm in length prior to smoking, said fuel element including a jacket of resilient insulating material around its circumference; and a physically separate aerosol generating means disposed longitudinally behind said fuel element, said aerosol generating means including a substrate bearing an aerosol forming substance; and wherein said fuel element further comprises at least two materials, contiguous throughout the length thereof, including a carbonaceous material which burns, and a non-burning material, a material which does not burn significantly when compared to the burning material, wherein said non-burning material is situated substantially within the periphery of the carbonaceous material.

16. The cigarette of claim 15, wherein at least a portion of the non-burning material in the fuel element extends beyond the periphery of the burnable material.

17. The cigarette of claim 15, wherein the non-burning material in the fuel element comprises a heat exchange material.

18. The cigarette of claim 17, wherein the heat exchange material comprises a non-burning carbon.

19. The cigarette of claim 17, wherein the heat exchange material comprises a graphite ribbon or foil.

20. The cigarette of claim 17, wherein the heat exchange material comprises a metal ribbon or foil.

21. A method of reducing the average temperature of carbonaceous fuel elements for smoking articles comprising forming such fuel elements as a composite member comprising at least two materials, contiguous throughout the length thereof, including a carbonaceous material which burns, and a material which does not burn significantly when compared to the burning material, wherein said non-burning material is situated substantially within the periphery of the carbonaceous material.

22. The method of claim 21, wherein the non-burning material in the fuel element comprises a heat exchange material.

23. The method of claim 22, wherein the heat exchange material comprises a non-burning carbon.

24. The method of claim 22, wherein the heat exchange material comprises a graphite ribbon or foil.

25. The method of claim 22, wherein the heat exchange material comprises a metal ribbon or foil.

* * * * *